US005174145A

United States Patent [19]

Tsuzuki

[11] Patent Number: 5,174,145

[45] Date of Patent: Dec. 29, 1992

[54] METHOD OF AND APPARATUS FOR MANUFACTURING TOP PLATE FOR METALLIC DRUM CONTAINER

[75] Inventor: Toshio Tsuzuki, Kanagawa, Japan

[73] Assignee: Tannan Co., Ltd., Kanagawa, Japan

[21] Appl. No.: 749,274

[22] Filed: Aug. 23, 1991

[30] Foreign Application Priority Data

Aug. 23, 1990 [JP] Japan ..... 2-221928

[51] Int. Cl.[5] ..... B21D 28/14

[52] U.S. Cl. ..... 72/335; 72/358; 72/379.2

[58] Field of Search ..... 72/335, 333, 332, 327, 72/358, 359, 379.2

[56] References Cited

U.S. PATENT DOCUMENTS

| | | | |
|---|---|---|---|
| 1,623,325 | 5/1927 | Wetmore | 72/327 |
| 2,021,960 | 11/1935 | Kramer | 72/333 |
| 2,271,762 | 2/1942 | Draper . | |
| 2,455,311 | 11/1948 | Meyers et al. . | |
| 2,460,720 | 2/1949 | Thompson . | |
| 3,923,192 | 12/1975 | Walters | 220/288 X |
| 4,109,501 | 8/1978 | Kozima | 72/335 |
| 4,111,029 | 9/1978 | Dulaquais | 72/358 |
| 4,706,836 | 11/1987 | Greck | 220/288 X |
| 4,852,238 | 8/1989 | Schurr | 29/453 |
| 4,956,989 | 9/1990 | Nakajima | 72/335 |

FOREIGN PATENT DOCUMENTS

| | | | |
|---|---|---|---|
| 1117525 | 11/1961 | Fed. Rep. of Germany | 72/335 |
| 206532 | 9/1986 | Japan | 72/335 |
| 602401 | 5/1948 | United Kingdom | 72/402 |

*Primary Examiner*—Daniel C. Crane
*Attorney, Agent, or Firm*—Paul A. Guss

[57] ABSTRACT

A circular hole is defined in a top plate stock of thin sheet steel, and a peripheral edge of the circular hole is raised and radially outwardly expanded into a substantially frustoconical first flange blank. Then, a peripheral edge of a proximal portion of the first flange blank is raised and radially outwardly expanded into a substantially frustoconical second flange blank contiguous to the first flange blank, the second flange blank having a lower portion beneath the peripheral edge of the proximal portion. Finally, the third flange blank is drawn into a tubular flange which has a predetermined inside diameter and a predetermined height.

29 Claims, 8 Drawing Sheets

METHOD OF AND APPARATUS FOR MANUFACTURING TOP PLATE FOR METALLIC DRUM CONTAINER

BACKGROUND OF THE INVENTION

1. Field of the Invention

The present invention relates to a method of and an apparatus for manufacturing a top plate for a metallic drum container, the top plate having an opening defined therein for introducing a material into or removing a material out of the metal drum container.

2. Description of the Prior Art

Generally, metallic drum containers comprise a cylindrical drum, a disk-shaped bottom plate closing the bottom of the cylindrical drum, and a disk-shaped top plate closing the top of the cylindrical drum.

FIG. 6 of the accompanying drawings shows one conventional top plate 50 for a metallic drum container, the top plate 50 having an opening 51 defined therein for introducing a material into or removing a material out of the metal drum container. The top plate 50 has a tubular flange 52 disposed around the peripheral edge of the opening 51 and extending upwardly therefrom.

A cylindrical attachment 53 is inserted in the tubular flange 52, and has an internally threaded inner wall surface 54. The cylindrical attachment 53 serves to receive therein a plug (not shown) for closing the opening 51. The plug has an externally threaded outer wall surface, which is threaded in the internally threaded inner wall surface 54 of the cylindrical attachment 53, thereby closing the opening 51.

To prevent the contents from leaking out of the metallic drum container, it is necessary that the cylindrical attachment 53 inserted in the tubular flange 52 be securely fixed to the flange 52. If the cylindrical attachment 53 and the tubular flange 52 were not securely fixed to each other, then the contents would leak through the gap between the cylindrical attachment 53 and the tubular flange 52. When the plug is removed from the opening 51, the cylindrical attachment 53 and the plug may possibly turn together, and the plug may not be detached from the cylindrical attachment 53. To alleviate this drawback, a seal member 55 is inserted between the tubular flange 52 and the cylindrical attachment 53 to allow the cylindrical attachment 53 to be reliably secured to the tubular flange 52 in intimate contact therewith. However, the process of inserting the seal member 55 is complex and costly.

The cylindrical attachment 53 that is inserted in the tubular flange 52 has a radially outwardly extending peripheral edge 56 projecting on the inner surface of the top plate 50, defining a stepped recess 57 thereon. When the stored material is removed from the metallic drum container, some material tends to be trapped in the recess 57, and the metallic drum container cannot fully be emptied. The trapped material cannot easily be cleared out of the recess 57 when the interior of the metallic drum container is cleaned for reuse.

U.S. Pat. No. 4,852,238 (Japanese Laid-Open Patent Publication No. 1-313119) discloses a method of making a top plate which has an opening but does not have any separate attachment.

According to the disclosed method, a region of the top plate where an opening is to be defined is raised upwardly to form a flat disk on its top, and the top plate stock is drawn from the center of the disk toward the peripheral edge thereof. Then, a circular hole that is smaller in diameter than the opening to be eventually formed is defined in the disk. The top plate stock that has been flowed toward the peripheral edge of the disk is raised upwardly into a tubular flange. At the same time, the circular hole is enlarged in diameter. Thereafter, the entire peripheral edge of the tip end of the flange is vertically compressed to increase the thickness of the flange. The inner wall surface of the flange is then internally threaded.

The increased thickness of the flange increases the mechanical strength of the flange. A plug is directly inserted in the tubular flange in threaded engagement with its internally threaded inner wall surface.

Since no separate attachment is employed, the cost is lowered, and the interior of the drum container can easily be cleaned.

However, the integral formation of the flange and the top plate poses the following problems Top plates for use on drum containers are generally made of thin sheet steel having a thickness in the range of from 1.0 mm to 1.2 mm, specifically SPHC for general use according to JIS (Japanese Industrial Standard) of Hot-Rolled Miled Steel Sheet, Strip and Plate, or SPCC for general use according to JIS of Cold-Rolled Carbon Steel Sheet and Strip. The top plates are required to have an opening for threaded engagement with a 2-inch (50.8 mm) plug and an opening for threaded engagement with a ¾-inch (19.05 mm) plug according to international standards. The flanges around the openings must have a height of about 8 mm so that the inner wall surfaces of the flanges are internally threaded over a length of 6 mm or more for threaded engagement with the plugs.

The SPHC, referred to above, whose wall thickness is 1.6 mm or less has an elongation percentage of 27%, which is smaller than the elongation percentage of 30% of SPHD that is to be machined by drawing and the elongation percentage of 31% of SPHE that is to be machined by deep drawing. Likewise, the SPCC whose wall thickness is 1.6 mm or less has an elongation percentage of 37%, which is smaller than the elongation percentage of 39% of SPCD that is to be machined by drawing and the elongation percentage of 41% of SPCE that is to be machined by deep drawing.

When a flange that is 8 mm high is formed on a top plate of SPHC or SPCC whose wall thickness ranges from 1.0 mm to 1.2 mm to define a ¾-inch opening according to the above conventional process, the flange may crack under stresses because of the limited elongation percentage.

The inner wall surface of the flange should preferably be internally threaded by roll threading rather than cutting because cut threads would reduce the mechanical strength of the flange. If a small crack were formed in the tip end of the flange at the time it is drawn, it might develop into a larger crack when the flange is internally threaded, and the top plate could not be available as a final product. Even with no crack formed in the flange, if the flange were progressively thinner toward its upper edge, then the flange might crack when it is internally threaded. To avoid this shortcoming, after the flange is formed by deep drawing, it is downwardly compressed to prevent the upper edge of the flange from becoming thinner, according to the conventional method described above. However, the step of downwardly compressing the flange in addition to the step of forming the flange makes the manufacturing apparatus complex.

SUMMARY OF THE INVENTION

In view of the aforesaid problems of the conventional method and apparatus for manufacturing top plates for metallic drum containers, it is an object of the present invention to provide a method of and an apparatus for manufacturing a top plate for a metallic drum container, of thin sheet steel, the top plate having an opening with a mechanically strong flange extending therearound.

According to the present invention, there is provided a method of manufacturing a top plate for a metallic drum container, the top plate having an opening defined therein and a tubular flange projecting upwardly and extending along a peripheral edge of the opening, the tubular flange having a predetermined height and a predetermined inside diameter, the method comprising defining a circular hole in a top plate stock of thin sheet steel, the circular hole having a diameter smaller than the inside diameter of the opening, raising and radially outwardly expanding a peripheral edge of the circular hole into a substantially frustoconical first flange blank, the first flange blank having a circular hole whose diameter is smaller than the inside diameter of the opening and a height smaller than the predetermined height of the tubular flange, raising and radially outwardly expanding a peripheral edge of a proximal portion of the first flange blank into a substantially frustoconical second flange blank contiguous to the first flange blank, the second flange blank having a lower portion beneath the peripheral edge of the proximal portion, the lower portion having a diameter which is substantially equal to the inside diameter of the tubular flange, the first and second flange blanks jointly serving as a substantially frustoconical third flange blank, and drawing the third flange blank into a tubular flange which has the predetermined inside diameter and the predetermined height.

The third flange blank is formed by a die which comprises an upper portion complementary in shape to an inner wall surface of the first flange blank and a lower portion contiguous to the upper portion and complementary in shape to an inner wall surface of the second flange blank.

The third flange blank is formed by raising the second flange blank progressively upwardly, forming the first flange blank progressively upwardly into the shape of the second flange blank when the second flange blank is raised, and raising the first flange blank as it is formed into the shape of the second flange blank, progressively upwardly.

According to the present invention, there is also provided an apparatus for manufacturing a top plate for a metallic drum container, the top plate having an opening defined therein and a tubular flange projecting upwardly and extending along a peripheral edge of the opening, the tubular flange having a predetermined height and a predetermined inside diameter, the apparatus comprising punching means for defining a circular hole in a top plate stock of thin sheet steel, the circular hole having a diameter smaller than the inside diameter of the opening, first forming means for pressing a peripheral edge of the circular hole to raise and radially outwardly expand the peripheral edge of the circular hole into a substantially frustoconical first flange blank, the first flange blank having a circular hole whose diameter is smaller than the inside diameter of the opening and a height smaller than the predetermined height of the tubular flange, second forming means for raising and radially outwardly expanding a peripheral edge of a proximal portion of the first flange blank into a substantially frustoconical second flange blank contiguous to the first flange blank, the second flange blank having a lower portion beneath the peripheral edge of the proximal portion, the lower portion having a diameter which is substantially equal to the inside diameter of the tubular flange, the first and second flange blanks jointly serving as a substantially frustoconical third flange blank, and third forming means for drawing the third flange blank into a tubular flange which has the predetermined inside diameter and the predetermined height.

The first, second, and third forming means comprise a first die having a cylindrical base portion and a head portion, the head portion comprising an upper portion complementary in shape to an inner wall surface of the first flange blank and a lower portion contiguous to the upper portion and complementary in shape to an inner wall surface of the second flange blank, and a second die having a circular hole, the base portion of the first die being insertable into the circular hole of the second die.

The punching means comprises a cylindrical third die, and a hole opening in the head portion of the first die, the third die being insertable in the hole.

The peripheral edge of the circular hole is raised and radially outwardly expanded into the first flange blank which is smaller in diameter than the tubular flange to be finally formed. The extent to which the first flange blank is formed is therefore relatively small, and the first flange blank is prevented from cracking when it is formed.

The proximal portion of the first flange blank is then raised and radially outwardly expanded into the second flange blank. The third flange blank that is composed of the first and second flange blanks is then raised into the tubular blank while increasing the diameter of the circular hole. Since the tubular blank is successively formed from the top plate stock by raising and radially outwardly expanding the flange blanks successively, the tubular blank is prevented from being greatly reduced in thickness at local regions thereof.

Therefore, the tip end of the tubular flange is prevented from cracking when it is formed. The tubular flange thus formed around the opening in the top plate has a relatively high degree of mechanical strength.

The above and other objects, features, and advantages of the present invention will become apparent from the following description when taken in conjunctio with the accompanying drawings which illustrate a preferred embodiment of the present invention by way of example.

DETAILED DESCRIPTION OF THE PREFERRED EMBODIMENT

Figure 1:
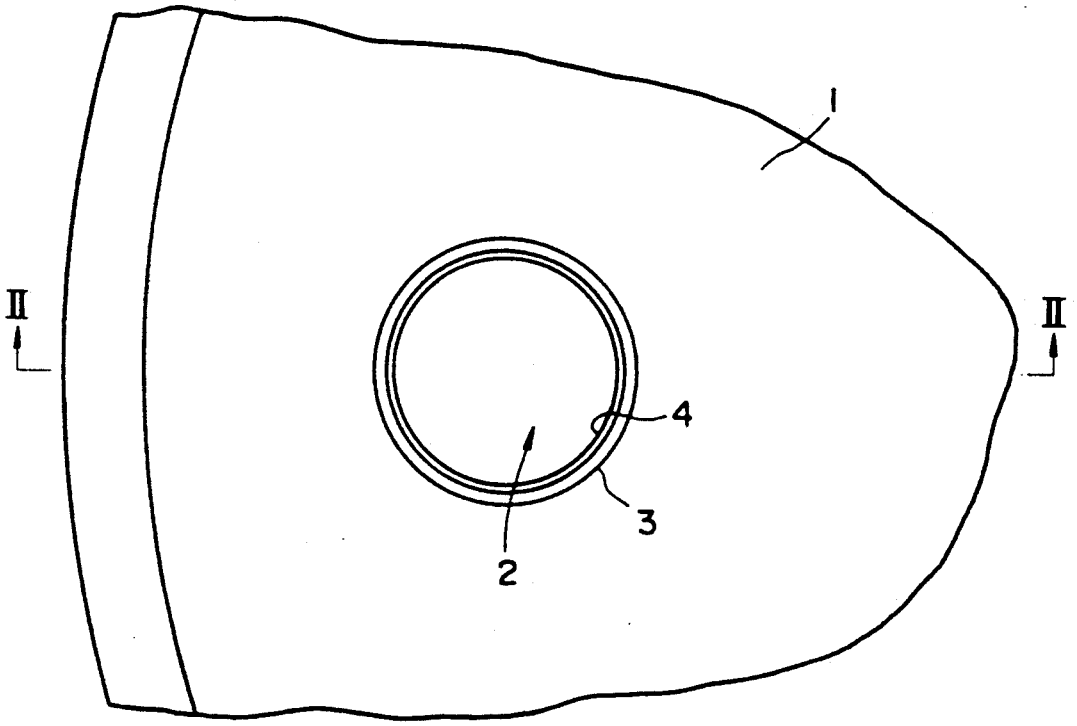
FIG. 1 is a fragmentary plan view of a top plate manufactured according to the present invention.
Figure 2:
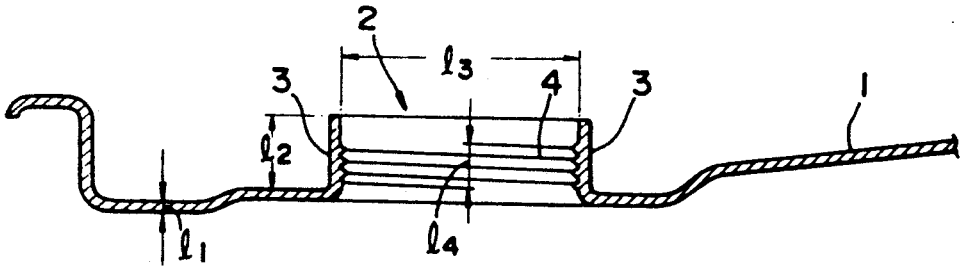
FIG. 2 is a cross-sectional view taken along line II—II of FIG. 1.

As shown in FIGS. 1 and 2, a disk-shaped top plate 1 for use on a metallic drum container (not shown) has a circular opening 2 defined therein. The top plate 1 also has a tubular flange 3 projecting upwardly and having an internally threaded inner wall surface 4. A plug (not shown) with an externally threaded outer wall surface can detachably be threaded into the opening 2.

The top plate 1 may be made of SPCC or SPHC and has a wall thickness $l_1$ of 1.2 mm. The flange 3 has a height $l_2$ of 8 mm from the top plate 1, and has an inside diameter $l_3$ of 25.1 mm so that an ordinary ¾-inch plug can be threaded in the flange 3. The internally threaded inner wall surface 4 of the flange 3 has an axial length $l_4$ of 6 mm, with the threads on the internally threaded inner wall surface 4 having a pitch of 1/14 inch.

Figure 3:
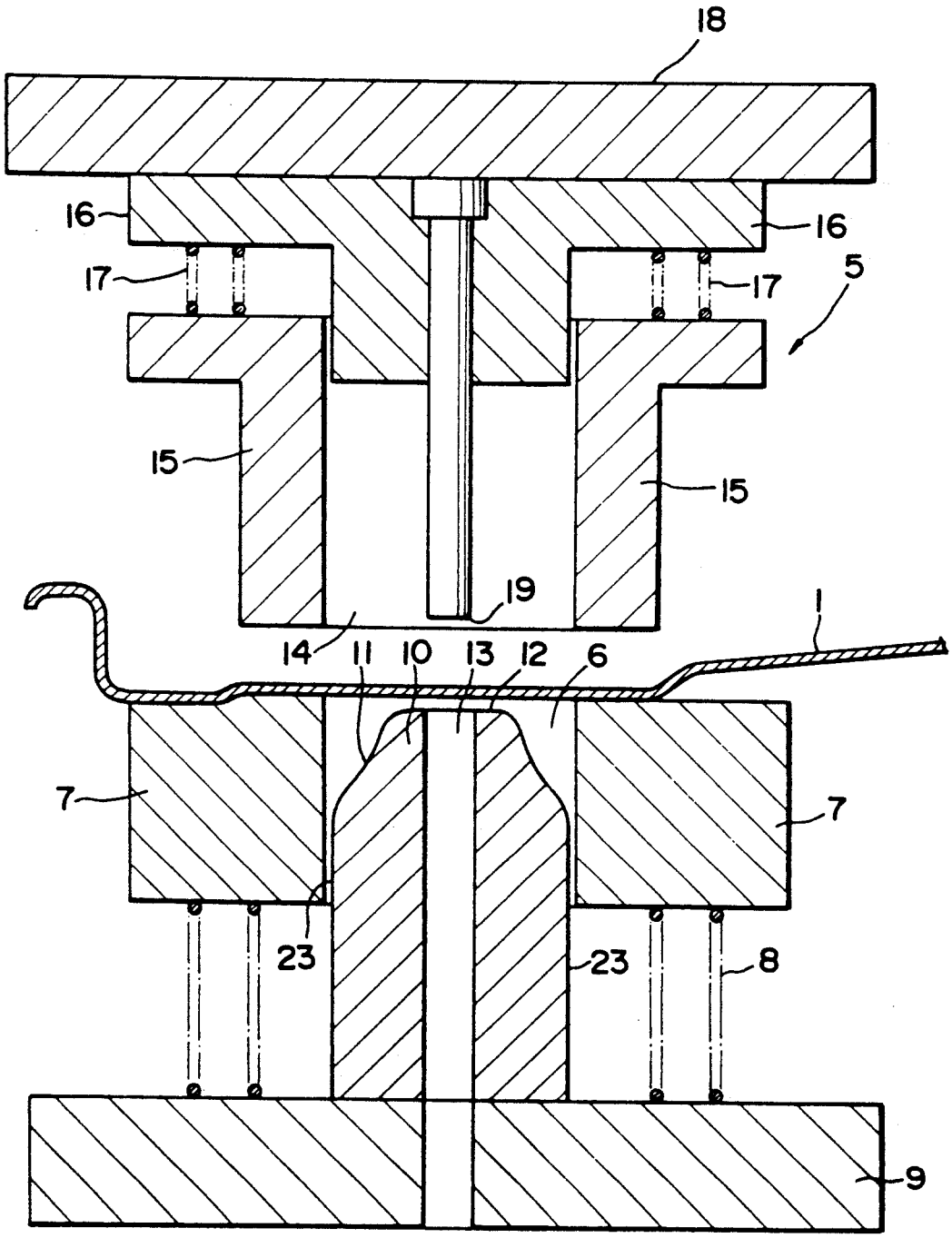
FIG. 3 is a vertical cross-sectional view of an apparatus according to the present invention.

The opening 2 is defined in the top plate 1 by an apparatus 5 shown in FIG. 3. The apparatus 5 has a lower die 7 with a tubular through hole 6 defined centrally therein, the lower die 7 being mounted on a lower base 9. The lower die 7 is normally urged to move upwardly by a spring 8 disposed between the lower base 9 and the lower die 7. A cylindrical inner die 10 is vertically fixedly mounted on the center of the lower base 9, and inserted in the through hole 6 in the lower die 7. The inner die 10 can extend upwardly through the hole 6 and projects upwardly of the lower die 7 when the lower die 7 is lowered. The inner die 10 has a shoulder 11 on its upper end portion, and a top 12 of reduced diameter which is positioned upwardly of the shoulder 11. The inner die 10 and the lower base 9 have a through hole 13 extending centrally therethrough in the vertical direction. The inner die 10 has a main portion having an outer wall surface 23 beneath the shoulder 10, the main portion having an outside diameter that is equal to the inside diameter $l_3$ of the flange 3.

The apparatus 5 also includes an upper die 15 disposed above the lower die 7 in confronting relationship thereto, the upper die 15 having a tubular forming region 14 which has a diameter corresponding to the diameter of the opening 2. The upper die 15 is mounted on a guide member 16 mounted on an upper base 18 and is normally urged to move downwardly by a spring 17 between the upper die 15 and the guide member 16 while being guided by the guide member 16. The guide member 16 has a punch rod 19 fixed thereto and projecting downwardly from the center of the lower end thereof. The punch rod 19 has a diameter corresponding to the inside diameter of the through hole 13 in the inner die 10, such that the punch rod 19 can be inserted into the through hole 13. The upper base 18 can be moved downwardly by an actuator (not shown).

Figure 4:
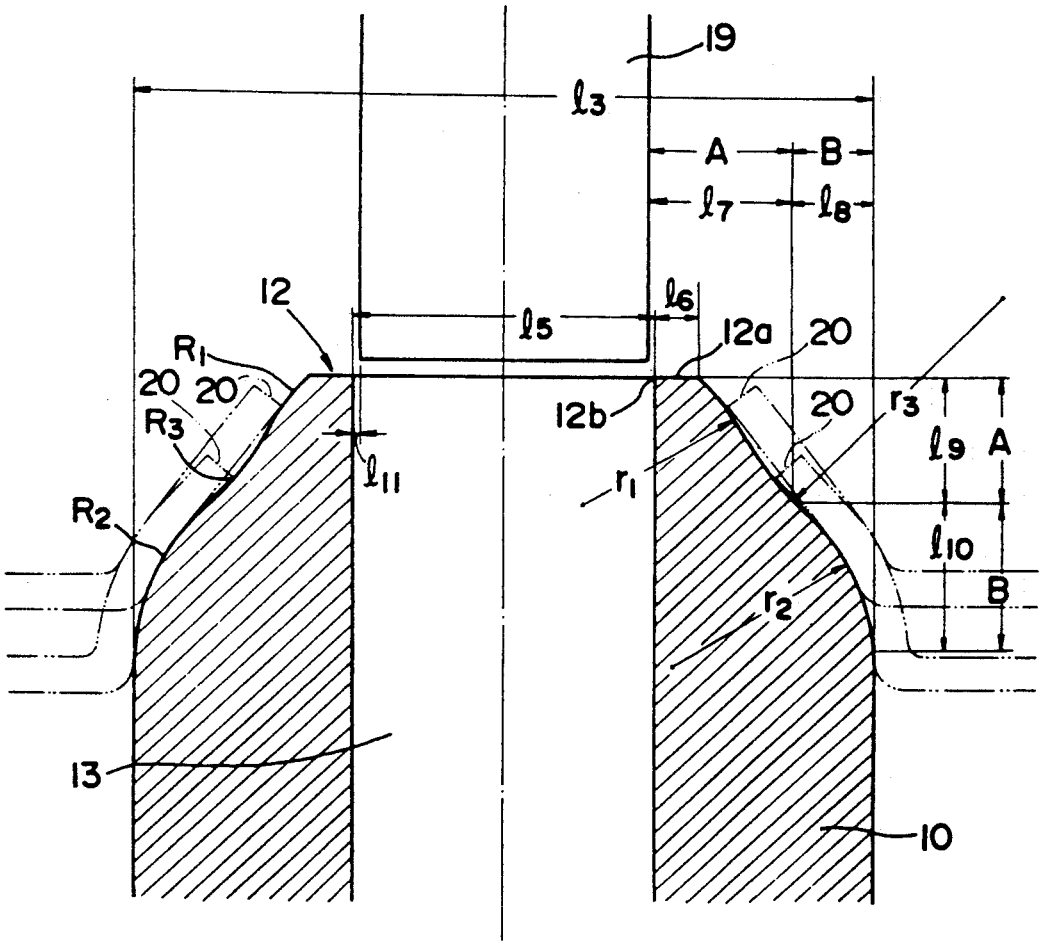
FIG. 4 is an enlarged fragmentary cross-sectional view of an inner die in the apparatus shown in FIG. 3.
Figure 5A:
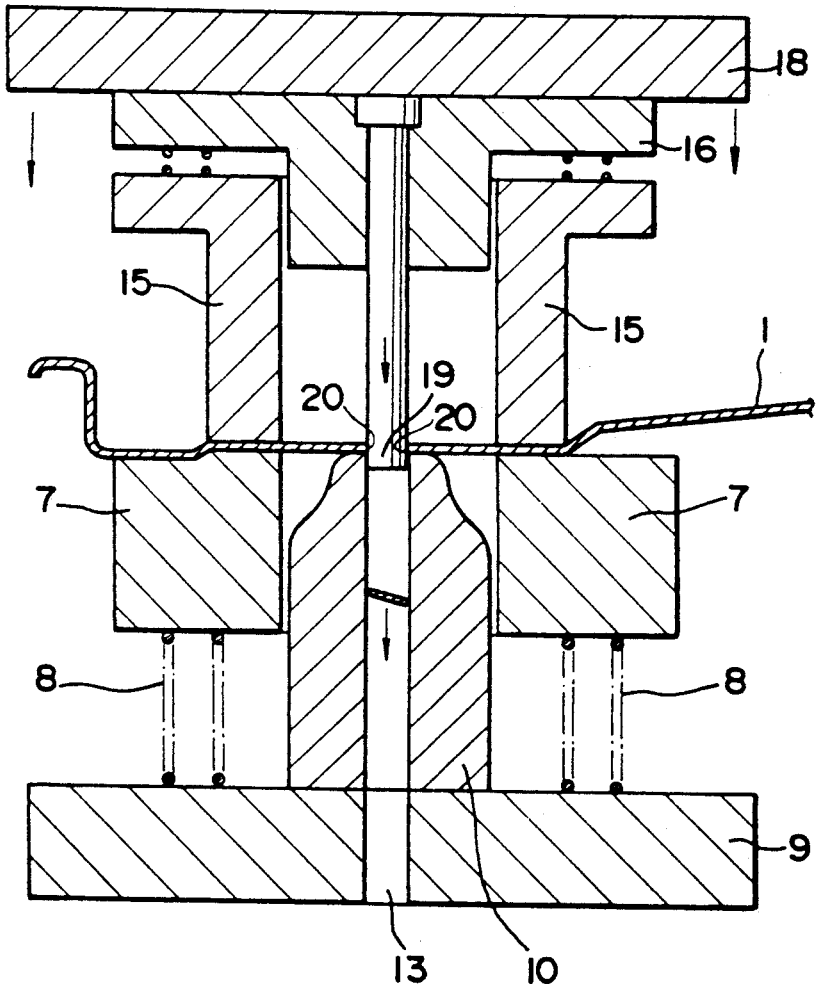
FIGS. 5(*a*) through 5(*d*) are vertical cross-sectional views showing successive steps of the method according to the present invention.
Figure 5B:
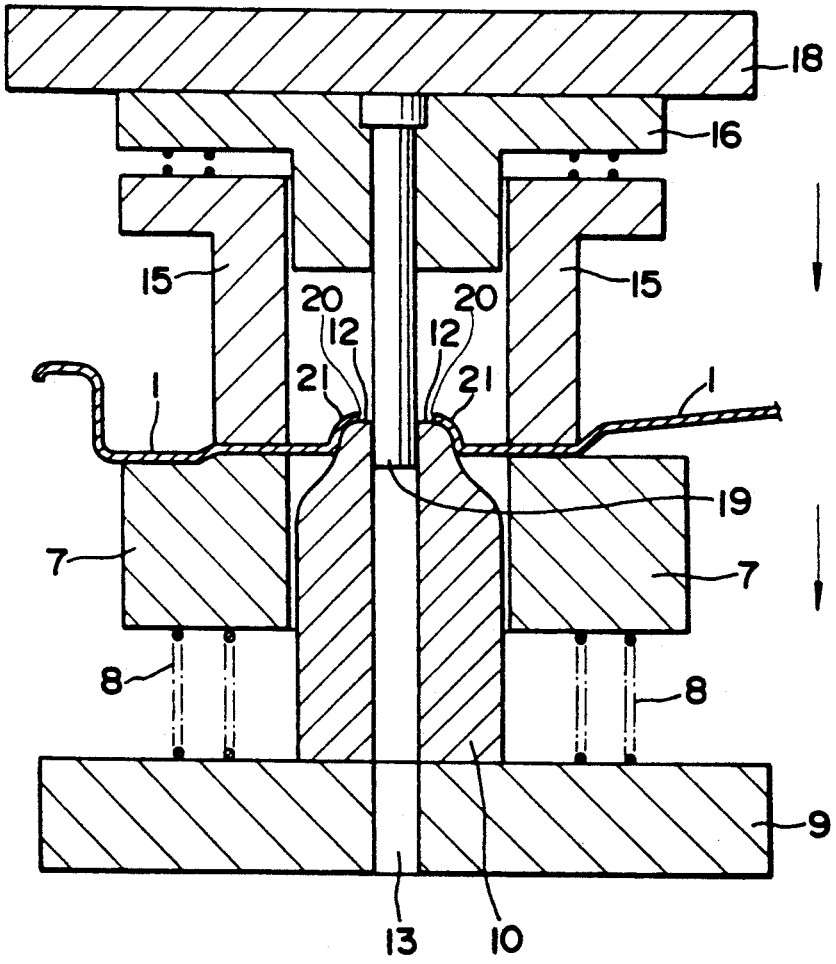
Figure 5C:
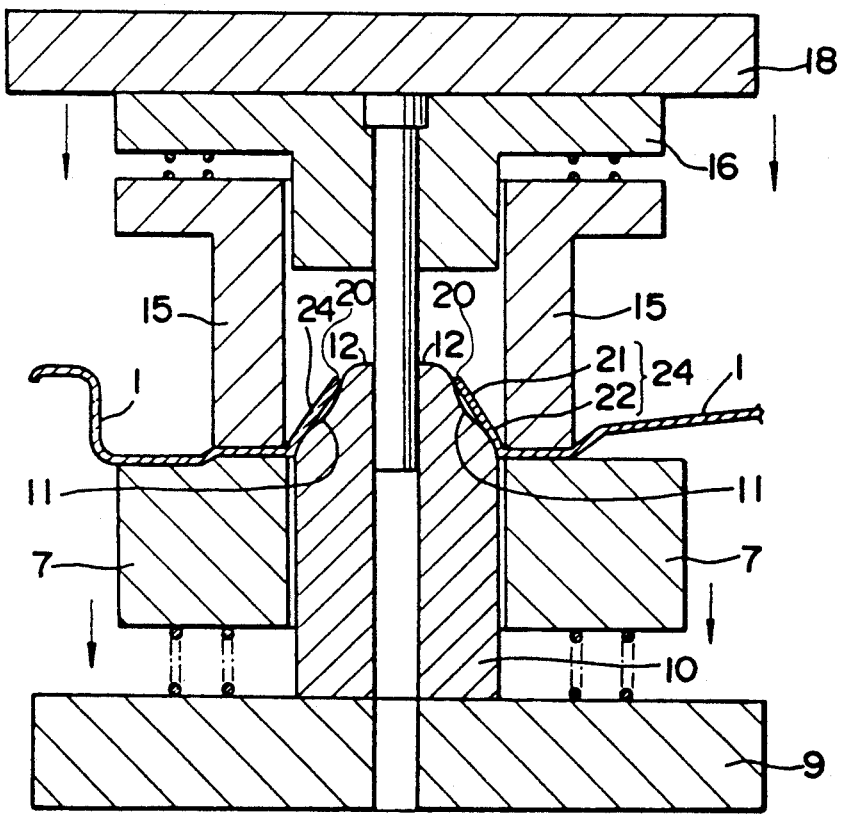
Figure 5D:
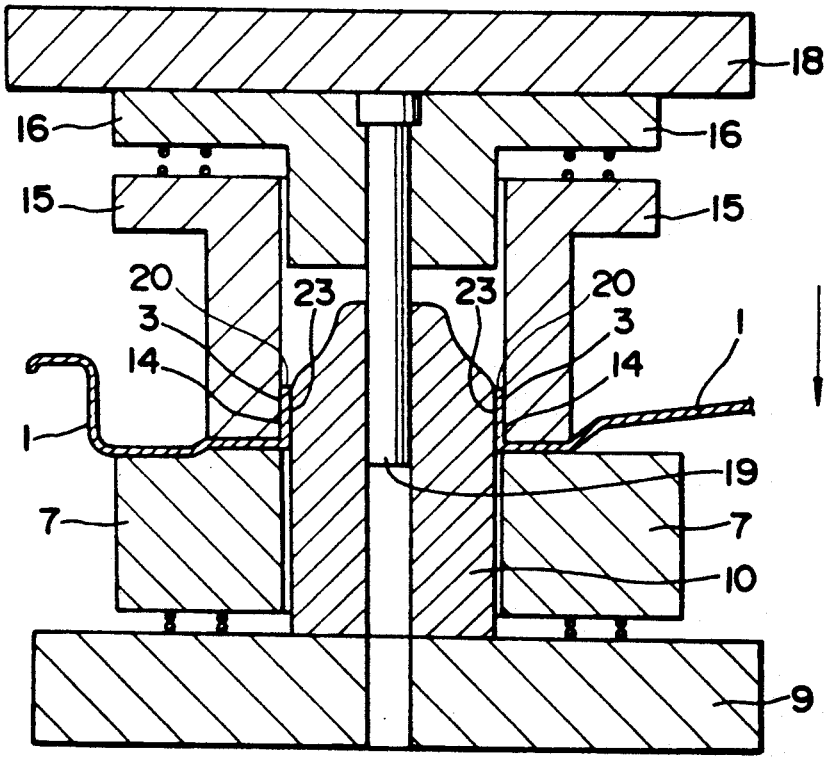
Figure 6:
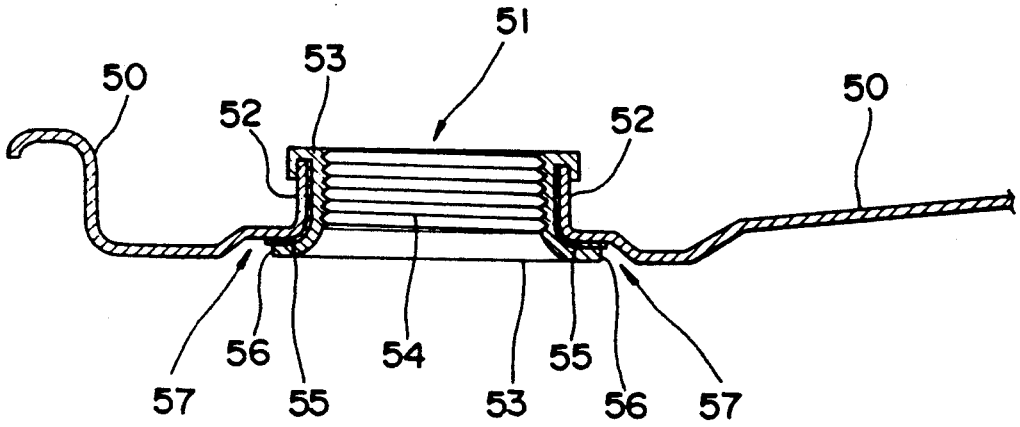
FIG. 6 is a cross-sectional view of a conventional top plate with an opening and an attachment.

The inner die 10 and the punch rod 19 will be described in detail with reference to FIG. 4.

The inside diameter, denoted at $l_5$, of the through hole 13 governs the height of the flange 3 that has been formed. The smaller the inside diameter $l_5$, the greater the height of the flange 3. If the inside diameter $l_5$ were too small, the flange 3 might crack when it is formed. Therefore, the inside diameter $l_5$ should appropriately be selected depending on the desired height of the flange 3. If the desired height of the flange 3 is 8 mm, then the inside diameter $l_5$ should preferably be 10.5 mm.

The top 12 of the inner die 10 has a flat surface **12*a* having a width $l_6$. The flat surface 12*a* has an edge 12*b* around the upper open end of the hole 13, the edge 12*b* serving as a cutting edge which cooperates with the punch rod 19 in punching the stock of the top plate 1. If the width $l_6$ were too small, then the top 12 of the inner die 10 would be damaged due to the load imposed on the top 12. If the width $l_6$ were too large, the tip end of the flange 3 would crack when the flange is formed. Accordingly, the width $l_6$ should appropriately be selected to avoid the damage to the top 12 and the crack of the flange 3. If the inner die 10 is made of SKDll according to JIS or D2 according to AISI ASTM, then the width $l_6$ should be in the range of from 1.0 mm to 1.5 mm, preferably from 1.2 to 1.3 mm to meet the conditions for forming the flange 3**.

The shoulder 11 of the inner die 10 is composed of first, second, and third round sections $R_1$, $R_2$, $R_3$ extending the entire circumferential surface thereof. The first round section $R_1$, which is the uppermost round section, is contiguous to the flat surface **12*a* of the top 12 and has a radially outwardly convex curved surface. The second round section $R_2$, which is the lowermost round section, is contiguous to the cylindrical section of the inner die 10 beneath the shoulder 11** and has a radially outwardly convex curved surface. The third round section $R_3$, which is positioned between the first and second round section $R_1$, $R_2$, has a radially inwardly concave curved surface.

The first and second round sections $R_1$, $R_2$ basically serve to draw upwardly the peripheral edge of a circular hole 20 that has been formed in the top plate stock by the punch rod 19 whose diameter is smaller than the out side diameters of the first and second round sections $R_1$, $R_2$, while raising the peripheral edge of the circular hole 20 into a substantially frustoconical shape and pressing the peripheral edge radially outwardly. More specifically, as indicated by the imaginary lines in FIG. 4, the peripheral edge of the circular hole 20 is formed substantially along the first and second round sections $R_1$, $R_2$. At first, the top plate stock does not contact the third round section $R_3$. When the peripheral edge of the circular hole 20 moves past the third round section $R_3$, the peripheral edge springs back into contact with the third round section $R_3$. At the time the peripheral edge of the circular hole 20 moves past the third round section $R_3$, the peripheral edge follows the third round section $R_3$, which releases strains that have been quickly accumulated in the peripheral edge when it has been formed by the first round section $R_1$. Thereafter, the peripheral edge of the circular hole 20 is raised upwardly into a substantially frustoconical shape and expanded radially outwardly to a desired diameter by the second round section $R_2$.

When the peripheral edge of the circular hole 20 is expanded radially outwardly by the first and second round sections $R_1$, $R_2$, the extent to which the peripheral edge is expanded radially outwardly is reduced at lower regions of the first and second round sections $R_1$, $R_2$.

In order that the first, second, and third round sections $R_1$, $R_2$, $R_3$ form the flange 3 without developing cracks therein and the upper edge of the flange 3 has substantially the same thickness as that of the top plate stock, it is necessary to satisfy the following conditions:

The extent to which the peripheral edge of the circular hole 20 is formed by a region A which extends from the flat surface **12*a* through the first round section $R_1$ to an intermediate position of the third round section $R_3$, and the extent to which the peripheral edge of the circular hole 20** is formed by a region B which extends from the intermediate position of the third round section $R_3$ to the lower end of the second round section $R_2$, are related to each other as follows:

The extent to which the peripheral edge is formed by the region A in the radially outward direction is greater than the extent to which the peripheral edge is formed by the region B in the radially outward direction. More specifically, the extent to which the peripheral edge is radially outwardly formed by the region A is 55 to 65%, preferably 60%, of the entire extent to which the peripheral edge is formed, and the extent to which the peripheral edge is radially outwardly formed by the region B is 35 to 45%, preferably 40%, of the entire extent to which the peripheral edge is formed. If the extent to which the peripheral edge is radially outwardly formed by the region A were greater than 65% of the entire extent, then the flange would tend to crack when it is formed. If the extent to which the peripheral edge is radially outwardly formed by the region A were smaller than 55%, then the formed flange would not have a desired height.

The extent to which the peripheral edge is formed by the region A in the direction of the height of the flange, i.e., in the axial direction, is substantially equal to or smaller than the extent to which the peripheral edge is formed by the region B in the direction of the height of the flange, i.e., in the axial direction. More specifically, the extent to which the peripheral edge is axially formed by the region A is 40 to 50%, preferably 45 to 49%, of the entire extent to which the peripheral edge is axially formed, and the extent to which the peripheral edge is axially formed by the region B is 50 to 60%, preferably 51 to 55%, of the entire extent to which the peripheral edge is formed. If the extent to which the peripheral edge is axially formed by the region A were smaller than 40% of the entire extent, then the formed flange would not have a desired height when it is formed. If the extent to which the peripheral edge is axially formed by the region A were greater than 50%, then the flange would tend to crack when it is formed.

To meet the conditions for drawing the flange 3, the region A has a radial length $l_7$ ranging from 4.0 mm to 4.8 mm, the region B has a radial length $l_8$ ranging from 2.6 mm to 3.3 mm, the region A has an axial length $l_9$ ranging from 3.8 mm to 4.8 mm, and the region B has an axial length $l_{10}$ ranging from 4.8 mm to 5.7 mm.

The curvature $r_1$ of the first round section $R_1$ should preferably be smaller than the curvature $r_2$ of the second round section $R_2$. The curvature $r_3$ of the third round section $R_3$ should preferably be greater than the curvatures $r_1$, $r_2$. Under the conditions for drawing the flange 3, the radius of the curvature $r_1$ ranges from 5.0 mm to 7.0 mm, the radius of the curvature $r_2$ ranges from 6.0 mm to 8.0 mm, and the radius of the curvature $r_3$ ranges from 8.0 mm to 12.0 mm.

In order to form the flange 3 without cracks, it is preferable to minimize a gap $l_{11}$ between the punch rod 19 and the edge of the through hole 13 in the inner die 10 when the circular hole 20 is defined in the top plate stock. Preferably, the gap $l_{11}$ should be in the range of from 0.03 mm to 0.05 mm. If the gap $l_{11}$ were too large, the peripheral edge of the circular hole 20 which has been cut by the punch rod 19 and the edge of the through hole 13 would be forced into the through hole 13 by the punch rod 19, presenting an obstacle to the enlargement of the peripheral edge of the circular hole 20 in the radially outward direction.

The process of forming the flange 2 with the apparatus 5 will be described below with reference to FIGS. 3, 4(*a*) through 4(*d*), and 5.

As shown in FIG. 3, a top plate stock 1 is placed on the upper surface of the lower die 7 with a region where the opening 2 is to be defined being aligned with the through hole 6.

Then, as shown in FIG. 5(*a*), the upper base 18 is moved downwardly until the top plate stock 1 is gripped between the upper die 15 and the lower die 7. The upper base 18 is further moved downwardly to cause the punch rod 19 to thrust through the top plate stock 1 into the through hole 13, thus defining a circular hole 20 in the top plate stock 1. The diameter of the circular hole 20 thus defined is smaller than the outside diameter of the inner die 10 which corresponds to the inside diameter of the opening 2 (FIG. 2).

As shown in FIG. 5(*b*), the upper base 18 is moved downwardly to depress the lower die 7 so that the upper portion of the inner die 10 projects above the lower die 7. The peripheral edge of the circular hole 20 is raised by the region A of the shoulder 11 of the inner die 10, and while at the same time, is radially outwardly expanded thereby into a first flange blank 21 of a substantially frustoconical shape. The first flange blank 21 is smaller in diameter and width than the flange 3 that is to be formed around the opening 2 in the top plate 1.

Then, as shown in FIG. 5(*c*), the upper base 18 is further moved downwardly to depress the lower die 7 so that the upper portion of the inner die 10 further projects above the lower die 7. The peripheral edge of a proximal portion of the first flange blank 21 is raised and radially outwardly expanded by the region B of the shoulder 11, thereby forming a substantially frustoconical second flange blank 22 that is downwardly contiguous to the first flange blank 21. The first and second flange blanks 21, 22 now jointly form a substantially frustoconical third flange blank 24. A lower portion of the third flange blank 24 has an inside diameter close to that of the flange 3 to be eventually formed.

Subsequently, as shown in FIG. 5(*d*), the upper base 18 is further moved downwardly to depress the lower die so that the upper portion of the inner die 10 further projects above the lower die 7. At this time, the third flange blank 24 is drawn into the flange 3 by an outer wall surface 23 of the inner die 10 below the shoulder 11 and the forming region 14 of the upper die 10.

As described above, the flange 3 is formed successively by the top 12, the shoulder 11, and the outer wall surface 23 of the inner die 10. In this manner, the flange 3 is prevented from cracking, and has substantially the same wall thickness as that of the top plate stock.

Thereafter, the inner wall surface 4 (see FIG. 2) of the flange 3 is internally threaded by roll threading, using grooved rolls (not shown). The opening 2 surrounded by the flange 3 is thus defined in the top plate 1.

Although a certain preferred embodiment of the present invention has been shown and described in detail, it should be understood that various changes and modifications may be made therein without departing from the scope of the appended claims.

What is claimed is:

1. A method of manufacturing a top plate for a metallic drum container, the top plate having an opening defined therein and a tubular flange projecting upwardly and extending axially from the opening, the tubular flange having a predetermined height and a predetermined inside diameter, said method comprising:

(a) defining a circular hole in a top plate stock of thin sheet steel, said circular hole having a diameter smaller than said inside diameter of the opening and having a peripheral edge immediately adjacent the opening;

(b) raising and radially outwardly expanding a peripheral edge of said circular hole over an upper portion of a die to form a substantially frustoconical first flange blank, said first flange blank having a circular hole whose diameter is smaller than said inside diameter of the openign and a height smaller than said predetermined height of the tubular flange, said upper portion of said die comprising a first rounded section projecting radially outwardly;

(c) raising and radially outwardly expanding a peripheral edge of a proximal portion of said first flange blank over a lower portion of said die to form a substantially frustoconical second flange blank contiguous to said first flange blank, said second flange blank having a lower portion beneath said peripheral edge of the proximal portion, said lower portion having a diameter which is substantially equal to said inside diameter of the tubular flange, said lower portion of said die comprising a second rounded section projecting radially outwardly, said first and second flange blanks jointly serving as a substantially frustconical third flange blank;

(d) drawing said third flange blank into a tubular flange which has said predetermined inside diameter and said predetermined height; and (e) passing said peripheral edge over a third rounded section of said die disposed between said first and second rounded sections, said third rounded section projecting radially inwardly so that as said peripheral edge moves from said first rounded section to said second rounded section said peripheral edge springs inwardly toward said third rounded section;

wherein said first, second and third rounded sections are fixedly disposed contiguously on said die such that said third rounded section merges with said first and second rounded sections.

2. A method according to claim 1, further including the step of internally threading an inner wall surface of said tubular flange after the step (d).

3. A method according to claim 1, wherein said top plate stock comprises either a sheet of hot-rolled mild steel or a sheet of cold-rolled carbon steel.

4. A method according to claim 3, wherein said sheet of hot-rolled mild steel has a thickness ranging from 1.0 mm to 1.6 mm and an elongation percentage of 27 % or less, and said sheet of cold-rolled mild steel has a thickness ranging from 1.0 to 1.6 mm and an elongation percentage of 37% or less.

5. A method according to claim 1, wherein said steps (a), (b), (c), (d) and (e) are successively carried out.

6. A method according to claim 1, wherein said step (c) comprises the steps of raising said second flange blank progressively upwardly, and then raising said first flange blank progressively upwardly.

7. A method according to claim 1, wherein said step (*d*) comprises the steps of raising said second flange blank progressively upwardly, forming said first flange blank progressively upwardly into the shape of said second flange blank when said second flange blank is raised, and raising said first flange blank as it is formed into the shape of said second flange blank, progressively upwardly.

8. A method according to claim 7, further including the step of releasing strains produced when the peripheral edge of the circular hole is radially outwardly expanded, at the time said first flange blank is formed progressively upwardly into the shape of said second flange blank in said step (d) and as said peripheral edge passes over said third flange blank in said step (e).

9. A method according to claim 1, wherein said step (*b*) comprises the step of pressing the peripheral edge of the circular hole in the top plate stock which is fixed, with a substantially frustoconical die.

10. A method according to claim 1, wherein said step (*c*) comprises the step of pressing the peripheral edge of the proximal portion of said first flange blank which is fixed, with a substantially frustoconical die.

11. A method according to claim 1, wherein said upper portion of the die is complementary in shape to an inner wall surface of said first flange blank and said lower portion of the die is contiguous to said upper portion and complementary in shape to an inner wall surface of said second flange blank.

12. A method according to claim 11, wherein said die has a flat surface on a top thereof, having a diameter greater than the diameter of said circular hole.

13. A method according to claim 1, wherein the radius of curvature of first rounded section is smaller than a the radius of curvature of said second rounded section.

14. A method according to cliam 1, wherein the radius of curvature of said first rounded section is smaller than the radius of curvature of said second rounded section, and the radius of curvature of said third rounded section is greater than the radii of curvature of said first and second rounded sections.

15. A method according to claim 1, wherein said die comprises a first die having a cylindrical base portion and a head portion, said head portion comprising said upper portion of the die and said lower portion of the die, and further comprising a second die having a circular hole, said base portion of the first die being insertable into said circular hole of said second die.

16. A method according to claim 1, wherein the extent to which said first flange blank is radially outwardly formed is 55 to 65% of the extent to which the tubular flange is finally radially outwardly formed.

17. A method according to claim 1, wherein the extent to which said first flange blank is axially formed is 55 to 65% of the extent to which the tubular flange is finally axially formed.

18. A method according to claim 1, wherein said first and second rounded sections are disposed on said die such that respective arcs defined by radii of curvature of said first rounded section and said second rounded section intersect each other.

19. An apparatus for manufacturing a top plate for a metallic drum container, the to plate having an opening defined therein and a tubular flange projecting upwardly and extending axially from the opening, the tubular flange having a predetermined height and a predetermined inside diameter, said apparatus comprising:

punching means for defining a circular hole in a top plate stock of thin sheet steel, said circular hole having a diameter smaller than said inside diameter of the opening and having a peripheral edge immediately adjacent the opening;

first forming means comprising a first rounded section disposed on an upper portion of a die and projecting radially outwarldy for pressing a peripheral edge of said circular hole to raise and radially outwardly expand the peripheral edge of said circular hole into a substantially frustoconical first flange blank, said first flange blank having a circular hole whose diameter is smaller than said inside diameter of the opening and a height smaller than said predetermined height of the tubular flange;

second forming means comprising a second rounded section disposed on a lower portion of said die and projecting radially outwardly for raising and radially outwardly expanding a peripheral edge of a proximal portion of said first flange blank into a substantially frustoconical second flange blank contiguous to said first flange blank, said second flange blank having a lower portion beneath said peripheral edge of the proximal portion, said lower portion having a diameter which is substantially equal to said inside diameter of the tubular flange, said first and second flange blanks jointly serving as a substantially frustoconical third flange blank;

a third rounded section disposed between said first and second rounded sections and projecting radially inwardly; and third forming means for drawing said third flange blank into a tubular flange which has said predetermined inside diameter and said predetermined height;

wherein said first, second and third rounded sections are fixedly disposed contiguously on said die such that said third rounded section merges with said first and second rounded sections so that said peripheral edge springs inwardly toward said third rounded section as said peripheral edge moves from said first rounded section to said second rounded section.

20. An apparatus according to claim 19, wherien said second forming means is disposed downwardly of said first formign means, and said third forming means is disposed downwardly of said second forming means.

21. An apparatus according to claim 19, said first forming means being complementary in shape to an inner wall surface of said first flange blank, said second forming means being complementary in shape to an inner wall surface of said second flange blank.

22. An apparatus according to claim 21, wherien said die has a flat surface on a top thereof, having a diameter greater than the diameter of said circular hole.

23. An apparatus according to claim 19, wherein the radius of curvature of first rounded section is smaller than the radius of curvature of said second rounded section.

24. An apparatus according to claim 19, wherein the radius of curvature of said first rounded section is smaller than the radius of curvature of said second rounded section, and the radius of curvature of said third rounded section is greater than the radii of curvature of said first and second rounded sections.

25. An apparatus according to claim 19, wherein said first, second, and third forming means comprise a first die having a cylindrical base portion and a head portion, said head portion comprising said upper portion of the die and said lower portion of the die, and further comprising a second die having a circular hole, said base portion of the first die being insertable into said circular hole of said second die.

26. An apparatus according to claim 25, wherein said punching means comprises a cylindrical third die, and a hole opening in the head portion of said first die, said third die being insertable in said hole.

27. An apparatus according to claim 19, wherein said first and second rounded sections are disposed on said die such that respective arcs defined by radii of curvature of said first rounded section and said second rounded section intersect each other.

28. A method of manufacturing a top plate for a metallic drum container, the top plate having an opening defined therein and a tubular flange projecting upwardly and extending axially from the opening, the tubular flange having a predetermined height and a predetermined inside diameter, said method comprising:

positioning a plate stock of thin sheet steel over a die member, said die member comprising a substantially cylindrical lower portion, and an upper head portion having a flat top surface and first and second substantially frustoconical forming surfaces, said first forming surface comprising a rounded convex surface disposed beneath said flat top surface and projecting radially outwardly therefrom, and said second forming surface comprising a rounded convex surface disposed beneath said first forming surface and projecting radially outwardly therefrom, and further comprising a concave rounded surface disposed between said first and second forming surfaces, wherein said first and second forming surfaces and said concave surface are fixedly disposed contiguously on said die such that said concave rounded surface means with said first and second forming surfaces;

punching a circular hole in said plate stock of sheet steel, said circular hole having a diameter smaller than a diameter of said top flat surface and having a peripheral edge immediately adjacent the opening;

pressing said sheet steel downwardly over said upper head portion of said die member, thereby forcing said upper head portion of said die member through said circular hole, whereby said circular hole and said peripheral edge of said sheet steel around said circular hole are progressively raised and expanded radially outwardly by said first and second forming surfaces with said peripheral edge springing inwardly toward said concave surface as said peripheral edge moves from said first forming surface to said second forming surface; and pressing said sheet steel further downwardly over said cylindrical lower portion of said die member thereby drawing said peripheral area into a tubular flange having said predetermined inside diameter and said predetermined height.

29. A method according to claim 19, wherein said first and second surfaces are disposed such that respective arcs defined by radii of curvature of said first forming surface and said second forming surface intersect each other.

* * * * *